US011473316B2

(12) United States Patent
Preston

(10) Patent No.: US 11,473,316 B2
(45) Date of Patent: Oct. 18, 2022

(54) RAINSCREEN INSTALLATION TOOL AND METHOD

(71) Applicant: Rainscreen Consulting, LLC, Rock Hill, SC (US)

(72) Inventor: Beau D. Preston, Rock Hill, SC (US)

(73) Assignee: RAINSCREEN CONSULTING, LLC, Rock Hill, SC (US)

( * ) Notice: Subject to any disclaimer, the term of this patent is extended or adjusted under 35 U.S.C. 154(b) by 220 days.

(21) Appl. No.: 17/042,455

(22) PCT Filed: Jun. 23, 2020

(86) PCT No.: PCT/US2020/039059
§ 371 (c)(1),
(2) Date: Sep. 28, 2020

(87) PCT Pub. No.: WO2020/263779
PCT Pub. Date: Dec. 30, 2020

(65) Prior Publication Data

US 2022/0056709 A1 Feb. 24, 2022

Related U.S. Application Data

(60) Provisional application No. 62/866,908, filed on Jun. 26, 2019.

(51) Int. Cl.
*E04F 21/00* (2006.01)

(52) U.S. Cl.
CPC ..... *E04F 21/0092* (2013.01)

(58) Field of Classification Search
CPC ... E04F 21/0092; E04F 13/0892; E04F 21/22; E04F 21/1844; E04F 15/02005
See application file for complete search history.

(56) References Cited

U.S. PATENT DOCUMENTS 2,031,684 A 2/1936 Berger
5,201,130 A 4/1993 Krchnak
(Continued)

FOREIGN PATENT DOCUMENTS

FR 2678663 A1 * 1/1993 ..... E04F 13/14

OTHER PUBLICATIONS

PCT International Search Report and Written Opinion cited in PCT/US/2020/039059 dated Sep. 14, 2020; 12 pages.

*Primary Examiner* — Babajide A Demuren
(74) *Attorney, Agent, or Firm* — Shumaker, Loop & Kendrick, LLP

(57) ABSTRACT

A rainscreen panel may be installed using tools for spacing, positioning, and attaching the rainscreen to a supporting structure. A rainscreen installation tool may have a first short leg and a second and third long leg extending from a center. One of the long legs may be orthogonal to the short leg and the other parallel to the short leg. The rainscreen installation tool may also have a fourth short leg extending from the center which is orthogonal to the first short leg. One or more of the rainscreen installation tools may be positioned with one of the short legs between an installed rainscreen panel and new rainscreen panel so that the new panel is appropriately spaced from the installed rainscreen panel. A fastener may be positioned at an edge of the rainscreen installation tool in order to secure the new rainscreen panel to the supporting structure.

10 Claims, 16 Drawing Sheets

(56) References Cited

U.S. PATENT DOCUMENTS

| | | | | |
|---|---|---|---|---|
| 6,385,858 | B1 | 5/2002 | Muller | |
| 6,769,191 | B1 * | 8/2004 | Zusman | E04F 21/0092 33/526 |
| 8,720,143 | B2 * | 5/2014 | Noutsis | E04F 21/0092 52/747.11 |
| 9,121,187 | B1 * | 9/2015 | Bunch | E04F 21/0092 |
| 9,181,713 | B1 | 11/2015 | Farahmandpour | |
| 10,032,266 | B1 | 7/2018 | Madey et al. | |
| 2004/0060184 | A1 * | 4/2004 | Shilo | E04F 21/0092 33/526 |
| 2004/0250435 | A1 * | 12/2004 | Fiore | E04F 21/0092 33/527 |
| 2010/0263316 | A1 | 10/2010 | Bruneau | |
| 2013/0298489 | A1 | 11/2013 | Gleeson et al. | |
| 2014/0069051 | A1 * | 3/2014 | Hillebrandt | E04F 15/02005 33/527 |
| 2016/0060883 | A1 | 3/2016 | Fetterman et al. | |
| 2016/0244975 | A1 * | 8/2016 | Jones | E04F 21/0092 |
| 2017/0265658 | A1 | 9/2017 | Lomax et al. | |
| 2018/0148924 | A1 | 5/2018 | Krause | |

* cited by examiner

RAINSCREEN INSTALLATION TOOL AND METHOD

CROSS-REFERENCE TO RELATED APPLICATIONS

This application is a Patent Cooperation Treaty (PCT) application tracing priority to U.S. Provisional Application No. 62/866,908 filed on Jun. 26, 2019, the entirety of which is expressly incorporated herein by reference.

TECHNICAL FIELD AND BACKGROUND OF THE INVENTION

This application relates to a rainscreen installation tool and method for using the tool to install rainscreen panels and rainscreen systems.

BACKGROUND OF THE INVENTION

Building structures may utilize various forms of veneers, coatings, siding, cladding, and the like for aesthetic, advertising/commercial, structural, and/or protective reasons. Such elements may be utilized on interior or exterior surfaces. Such elements may be utilized on horizontal and vertical surfaces and every angle in between. In particular, rainscreens may be used as a form of siding or cladding for such building surfaces.

A screen generally is a barrier, and in this case, a "rainscreen" or rainscreen system includes a rainscreen panel that provides a water barrier for an inner surface of a wall. More specifically, a rainscreen is an exterior wall detail that deflects most rainwater away from an inner surface of the wall. In a sense a rainscreen system provides a double-wall construction that utilizes a surface to help keep the rain out, as well as an inner layer to offer thermal insulation, prevent excessive air leakage and carry wind loading. The surface "breathes" just like a skin as the inner layer reduces energy losses.

The term rainscreen has origins in the use of an exterior cladding to protect a building system from elements, such as rain, but the use has expanded to encompass cladding for interior applications as well.

Rainscreens typically may be constructed in panels of various lengths and widths and may be installed in ways to minimize exposure of attachment elements.

It may also be important to correctly space one panel of a rainscreen from another for both aesthetic reasons and structural reasons. It may also be important to correctly space a rainscreen panel apart from flashing and/or coping near edge surfaces of the rainscreen panels.

Accordingly, there is a need in the art for a tool and method of installing rainscreen panels.

SUMMARY OF THE INVENTION

A rainscreen installation tool may have a center, a first short leg extending from the center a first distance and having a first width equivalent to the first distance, a second long leg orthogonal to the first short leg and extending from the center a second distance and having a second width equivalent to the first width, and a third long leg parallel to the first short leg and orthogonal to the second leg and extending from the center a third distance and having a third width equivalent to the first and second widths. The first distance may be less than the second distance and the third distance. The first, second, and third widths and the first distance may be based on a rainscreen panel manufacturer specification for width of a rainscreen panel to be installed using the rainscreen installation tool. Each leg of the tool may have an equivalent depth which may be greater than the first distance.

A rainscreen installation tool may have a center, a first short leg extending from the center a first distance and having a first width equivalent to the first distance, a second long leg orthogonal to the first short leg and extending from the center a second distance and having a second width equivalent to the first width, a third long leg parallel to the first short leg and orthogonal to the second long leg and extending from the center a third distance and having a third width equivalent to the first and second widths, and a fourth short leg parallel to the second long leg, orthogonal to the first short leg, and orthogonal to the third long leg and extending from the center a fourth distance and having a fourth width equivalent to the first, second, and third widths. The first distance may be less than the second distance and the third distance. The fourth distance may be equal to the first distance. The first, second, and third widths and the first distance may be based on a rainscreen manufacturer specification for width of a rainscreen panel to be installed using the rainscreen installation tool. Each leg of the tool may have an equivalent depth greater than the first distance.

A rainscreen panel may be installed by using a one or more rainscreen installation tools. According to such a method of installing a rainscreen panel, one step may include providing identical first and second rainscreen installation tools each having a first short leg extending from its center, a second long leg orthogonal to the first leg and extending from its center, and a third long leg parallel to the first short leg and orthogonal to the second leg and extending from its center. Another step may include positioning the first tool in a joint between an installed rainscreen panel and a new rainscreen panel such that the first short leg rests against the installed rainscreen panel and an end of the first short leg is in contact with a supporting structure, the second leg rests against a vertical side of the new rainscreen panel, and the third leg rests between the horizontal sides of the installed rainscreen panel and the new rainscreen panel. Another step may include positioning the second tool in the joint between the installed rainscreen panel and the new rainscreen panel so that its first short leg is inserted into the joint causing the second leg to rest flush against the new rainscreen panel and the third leg to extend outwardly from the joint and both rainscreen panels. A final step may include installing the new rainscreen panel.

An additional step may include positioning the second tool adjacent the first tool so that they are flush with one another and then positioning a fastener for the new rainscreen panel at a top corner of the second leg of the second tool.

According to such a method, the first short leg may have a length equal to a thickness of the new rainscreen panel and wherein a thickness of the second long leg and a thickness of the third long leg is equal to the length of the first short leg. Further, the second long leg may have a length equal a distance adjacent the joint for placement of a fastener. Further, the third long leg may have a length equal to a distance adjacent the joint for placement of a fastener.

A rainscreen panel may be installed by using a one or more different rainscreen installation tools. According to such a method, a step may include providing a plurality of first rainscreen installation tools. Each of the first rainscreen installation tools may have a center; a first short leg extending from the center a first distance and having a first width, a second long leg orthogonal to the first short leg and extending from the center a second distance and having a second width equivalent to the first width, and a third long leg parallel to the first short leg and orthogonal to the second leg and extending from the center a third distance and having a third width equivalent to the first and second widths. Another step may include providing a plurality of second rainscreen installation tools. Each of the second rainscreen installation tools may have a center, a first short leg extending from the center a first distance and having a first width, a second long leg orthogonal to the first short leg and extending from the center a second distance and having a second width equivalent to the first width, a third long leg parallel to the first short leg and orthogonal to the second long leg and extending from the center a third distance and having a third width equivalent to the first and second widths, and a fourth short leg parallel to the second long leg, orthogonal to the first short leg, and orthogonal to the third long leg and extending from the center a fourth distance and having a fourth width equivalent to the first, second, and third widths. Another step may include positioning the first short leg of one of the first rainscreen installation tools and either the first short leg or the fourth short leg of one of the second rainscreen installation tools between a joint between an installed rainscreen panel and the new rainscreen panel. A final step may include attaching the new rainscreen panel to a supporting structure.

Further, the first, second, and third widths of the first rainscreen installation tools may be equal to the first, second, third, and fourth widths of the second rainscreen installation tools. Also, the first, second, and third widths of the first rainscreen installation tools and the first, second, third, and fourth widths of the second rainscreen installation tools may be equal to a thickness of the joint. Also, the first distance of the first rainscreen installation tools may be equal to the first and fourth distances of the second rainscreen installation tools. Also, the first distance of the first rainscreen installation tool and the first and fourth distances of the second rainscreen installation tools may be equal to a thickness of the new rainscreen panel.

According to such a method, an additional step may include positioning either the first short leg or the fourth short leg of another one of the plurality of second rainscreen installation tools in a joint between the new rainscreen panel and a second installed rainscreen panel such that the joint between the new rainscreen panel and the second installed rainscreen panel is orthogonal to the joint between the installed rainscreen panel and the new rainscreen panel. Another step may include further positioning the one of the plurality of second rainscreen installation tools so that the center of the second rainscreen installation tool abuts the edge of one of the legs the another one of the plurality of second rainscreen installation tools. Another step may include positioning the fastener into the new rainscreen panel at a corner where the one of the plurality of second rainscreen installation tools meets the another one of the plurality of second rainscreen installation tools.

A rainscreen panel may be installed by using a one or more different rainscreen installation tools. Such a method may include a step of providing a plurality of first rainscreen installation tools. Each of the first rainscreen installation tools may have a center, a first short leg extending from the center a first distance and having a first width equivalent to the first distance, a second long leg orthogonal to the first short leg and extending from the center a second distance and having a second width equivalent to the first width, and a third long leg parallel to the first short leg and orthogonal to the second leg and extending from the center a third distance and having a third width equivalent to the first and second widths. Another step may include providing a plurality of second rainscreen installation tools. Each of the second rainscreen installation tools may have a center, a first short leg extending from the center a first distance and having a first width equivalent to the first distance, a second long leg orthogonal to the first short leg and extending from the center a second distance and having a second width equivalent to the first width, a third long leg parallel to the first short leg and orthogonal to the second long leg and extending from the center a third distance and having a third width equivalent to the first and second widths, and a fourth short leg parallel to the second long leg, orthogonal to the first short leg, and orthogonal to the third long leg and extending from the center a fourth distance and having a fourth width equivalent to the first, second, and third widths. Another step may include providing a plurality of rainscreen panels. Each of the panels may have at least two edges which join at a right angle. Another step may include attaching a first one of the plurality of rainscreen panels to a supporting structure. Another step may include positioning one of the second rainscreen installation tools so that the center is in contact with the supporting structure, one of the legs of the second rainscreen installation tools rests on a top edge of the at least two edges of the first one of the plurality of rainscreen panels, and another one of the legs of the second rainscreen installation tool is in contact with an adjacent edge of the at least two edges of the first one of the plurality of rain screen panels. Another step may include positioning one of the first rainscreen installation tools so that the first short leg rests on the top edge of the at least two edges of the first one of the plurality of rainscreen panels and the second long leg is in contact with an outer surface of the first one of the plurality of rainscreen panels. Another step may include positioning a second one of the plurality of rainscreen panels so that a bottom edge of the at least two edges of the second one of the plurality of rainscreen panels rests on a top surface of the first short leg of the first rainscreen installation tool, the bottom edge of the at least two edges of the second one of the plurality of rainscreen panels also rests on a top surface of one of the legs of the second rainscreen installation tool, and an adjacent edge of the at least two edges of the second one of the plurality of rainscreen panels is in contact with one of the legs of the second rainscreen installation tool. A final step may include attaching the second one of the plurality of rainscreen panels to the supporting structure so that a joint is formed between the first and second ones of the plurality of rainscreen panels.

A rainscreen panel may be installed along with coping and/or flashing. A method of accomplishing this may include the steps of providing a rainscreen installation tool having: a center, a first short leg extending from the center a first distance and having a first width, a second long leg orthogonal to the first short leg and extending from the center a second distance and having a second width equivalent to the first width, a third long leg parallel to the first short leg and orthogonal to the second long leg and extending from the center a third distance and having a third width equivalent to the first and second widths, a fourth short leg parallel to the second long leg, orthogonal to the first short leg, and orthogonal to the third long leg and extending from the center a fourth distance and having a fourth width equivalent to the first, second, and third widths. Another step may include positioning a rainscreen panel against a supporting structure.

According to such a method, a further step may include positioning a coping having an outer exposed surface and an inner surface about but not in contact with an outer surface of the rainscreen panel and about but not in contact with an edge of the rainscreen panel. A further step may include using the rainscreen installation tool as a spacer so that a furthest edge of the first short leg and a furthest edge of the fourth short leg may both be in contact with the inner surface of the coping.

According to such a method, a further step may include positioning a flashing having an outer exposed surface and an inner surface about but not in contact with an edge of the rainscreen panel. A further step may include using the rainscreen installation tool as a spacer so that a furthest edge of the first short leg is in contact with the inner surface of the flashing.

As used herein, the terms flashing and coping may have equivalent meaning and the use of coping and/or flashing should not be read to exclude the other term.

BRIEF DESCRIPTION OF THE DRAWINGS

Figure 1:
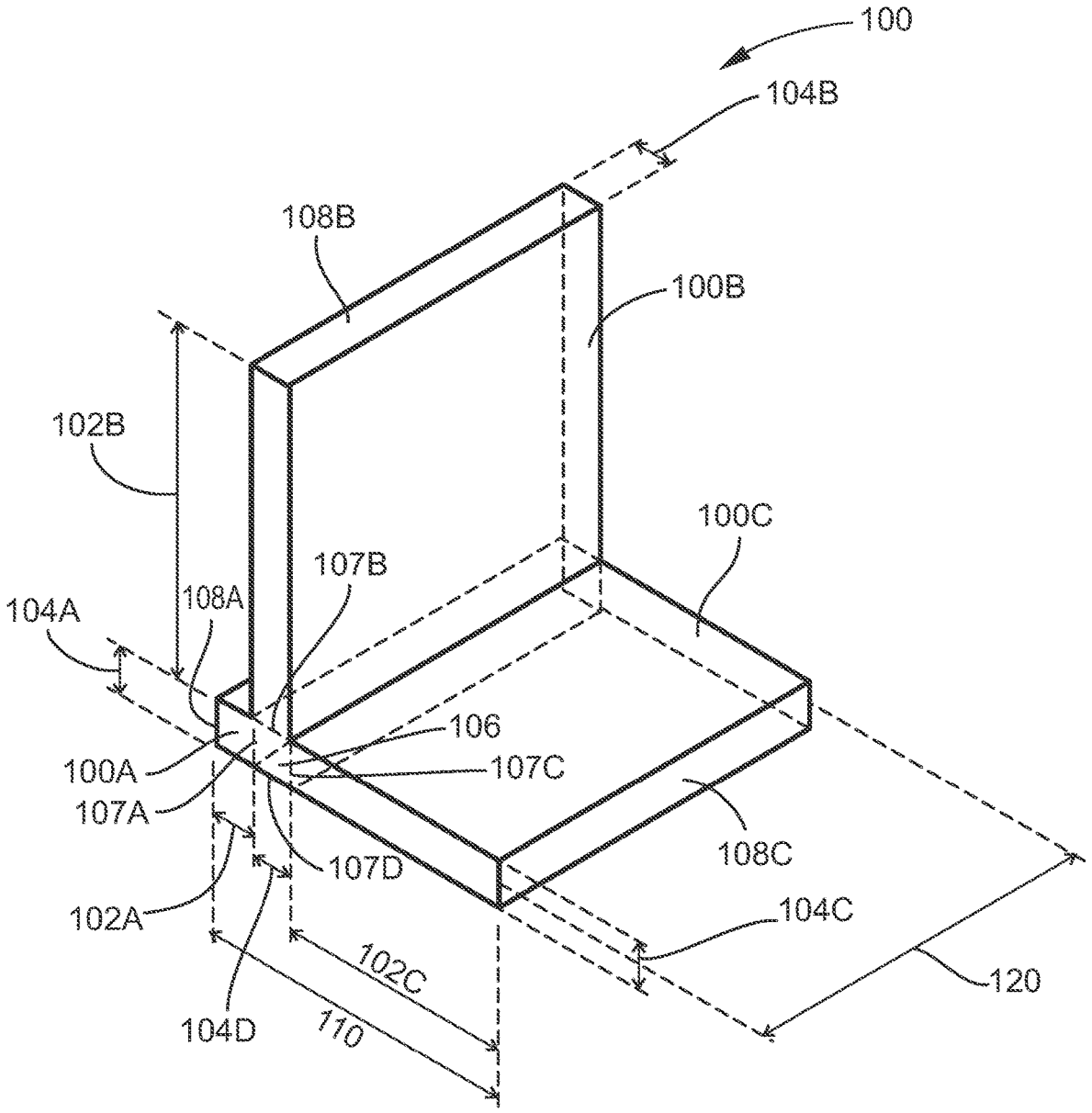
Figure 2B:
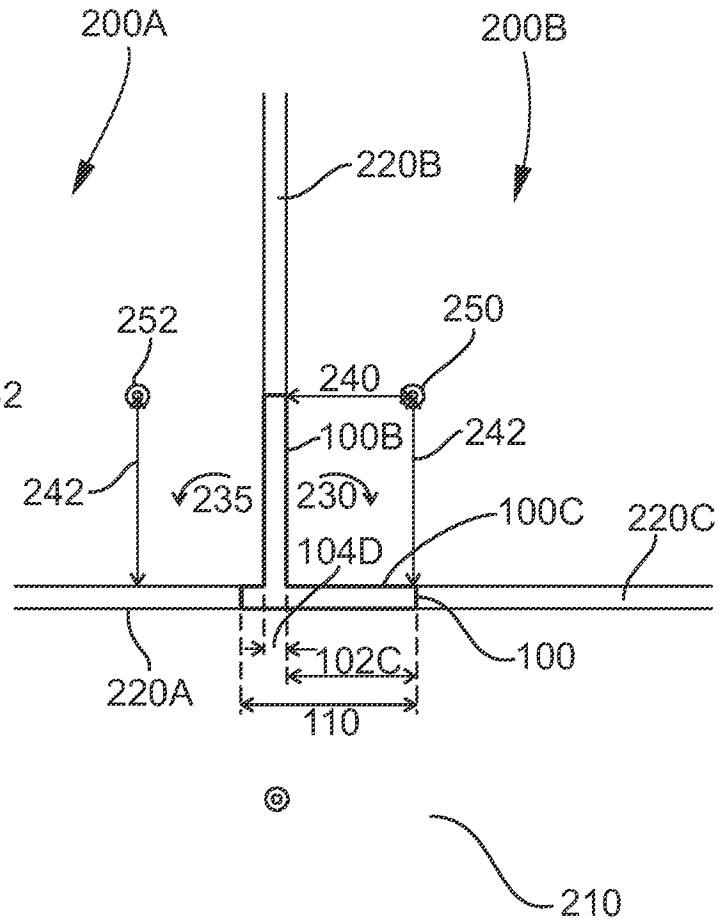
Figure 2A:
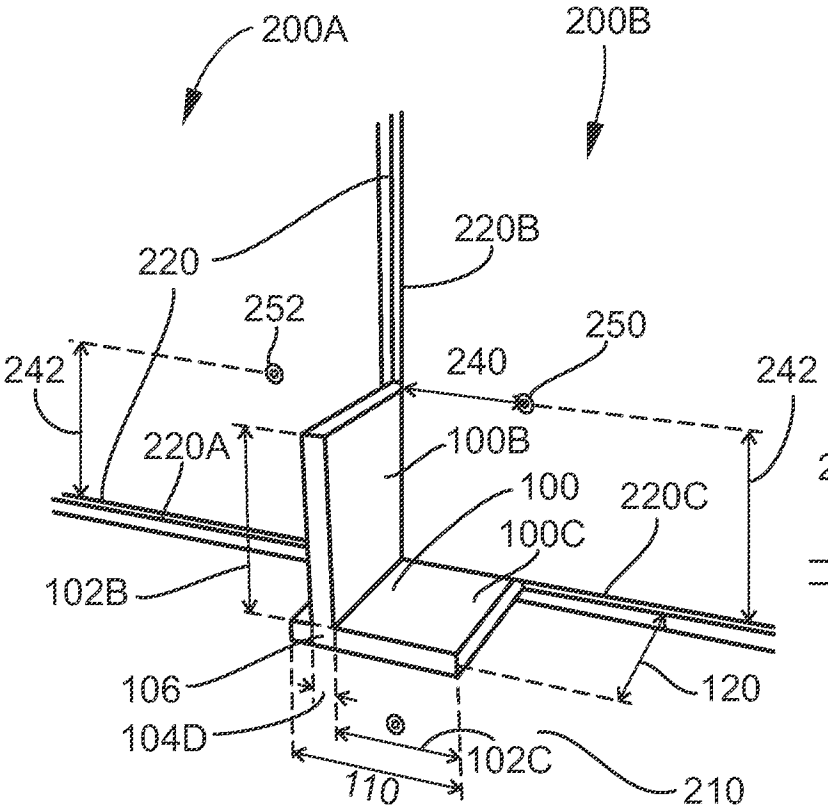
Figure 3B:
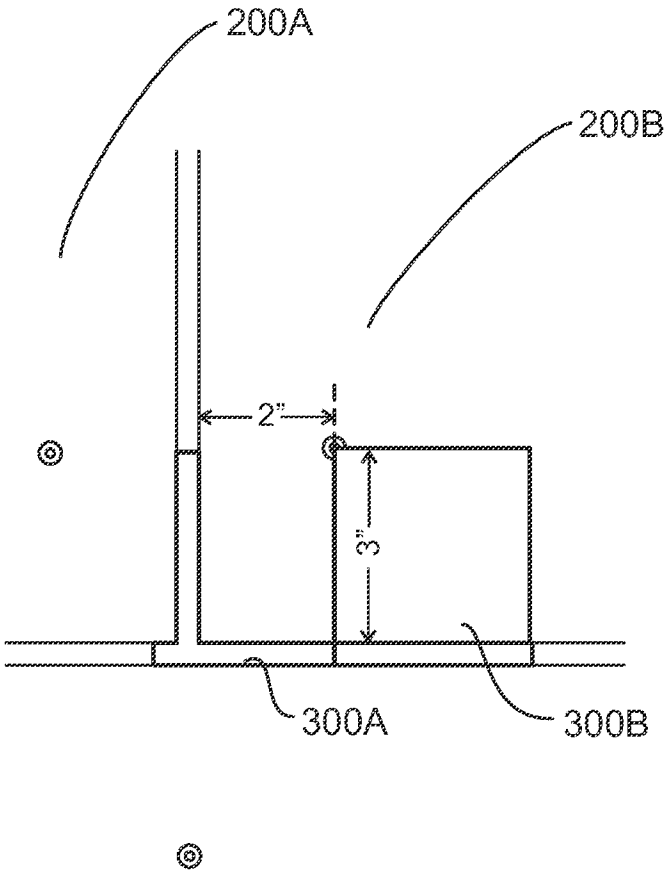
Figure 3A:
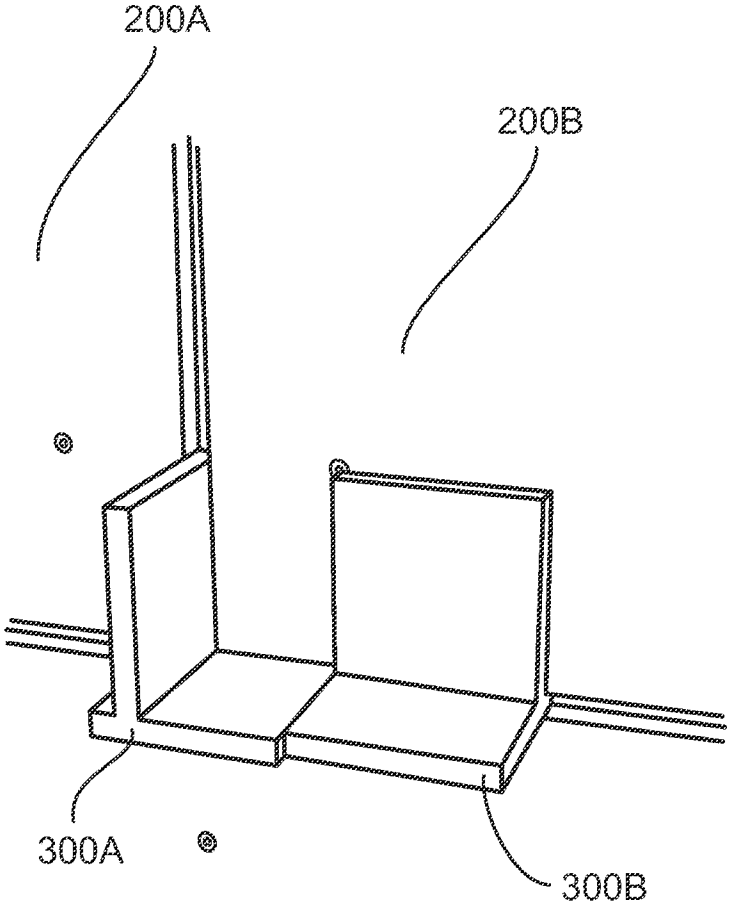
Figure 4A:
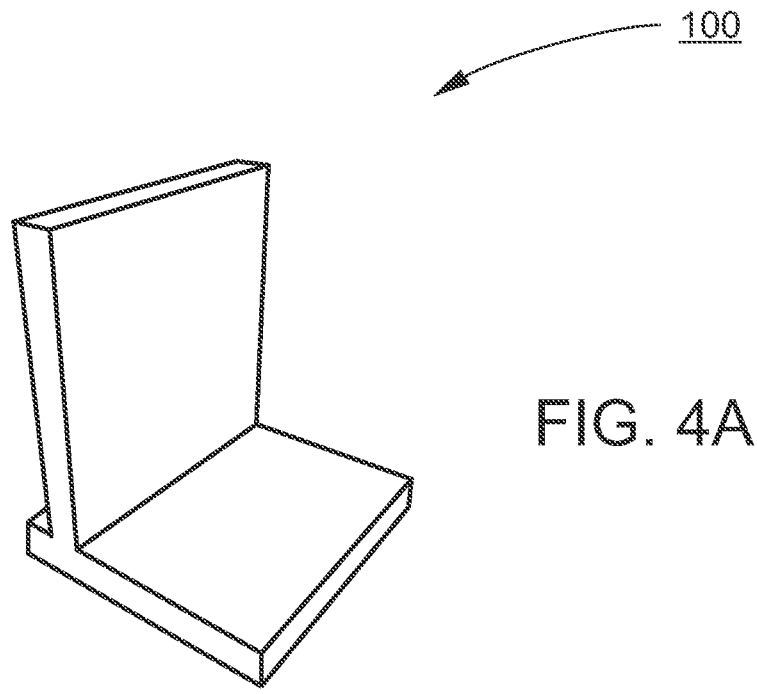
Figure 4B:
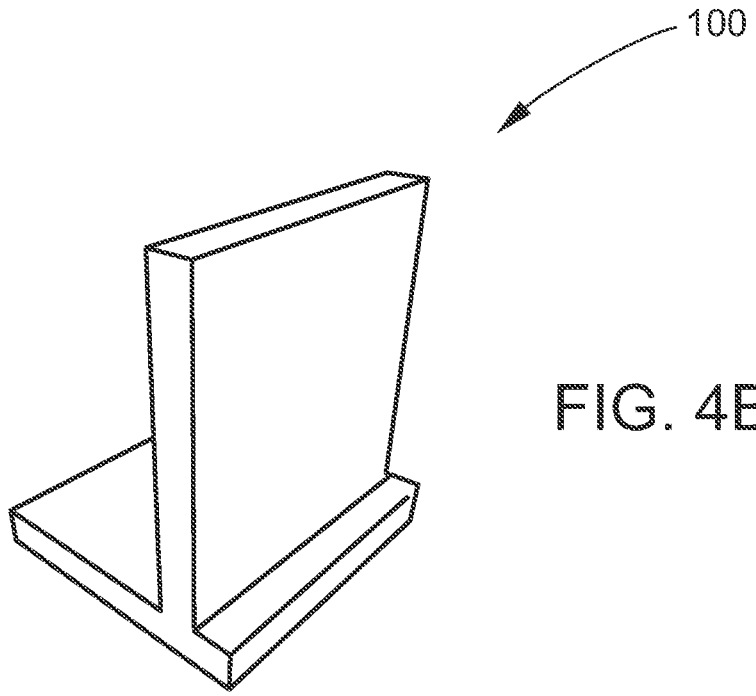
Figure 4C:
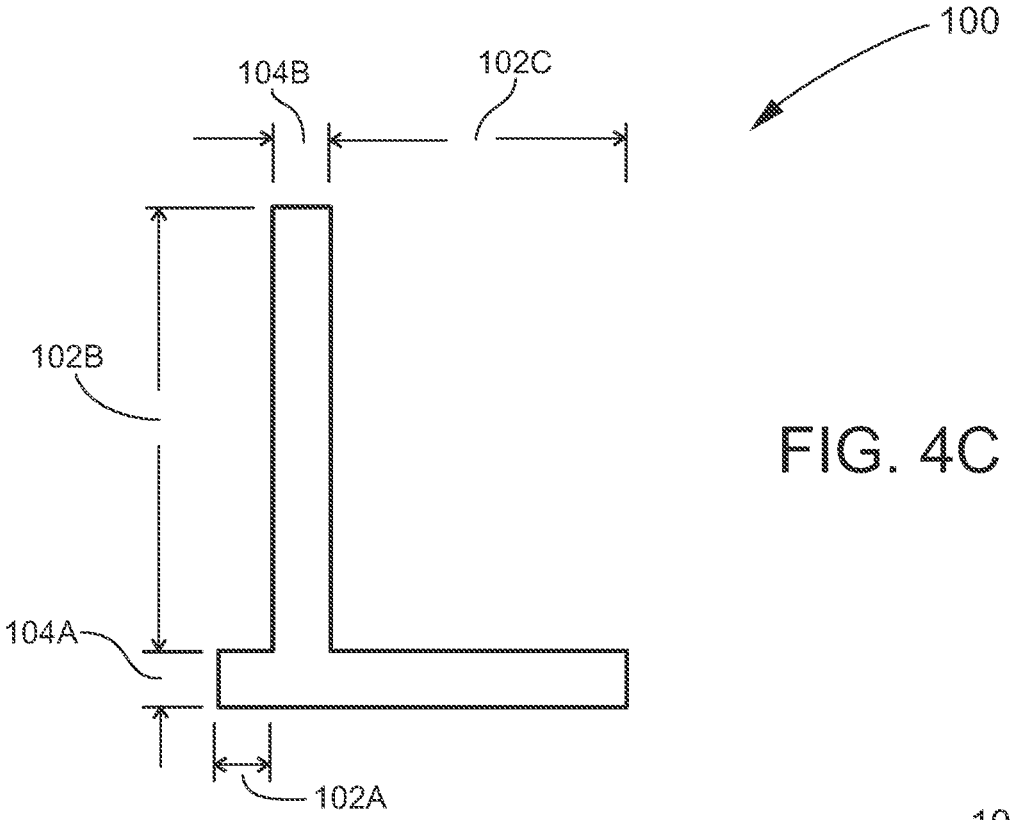
Figure 4D:
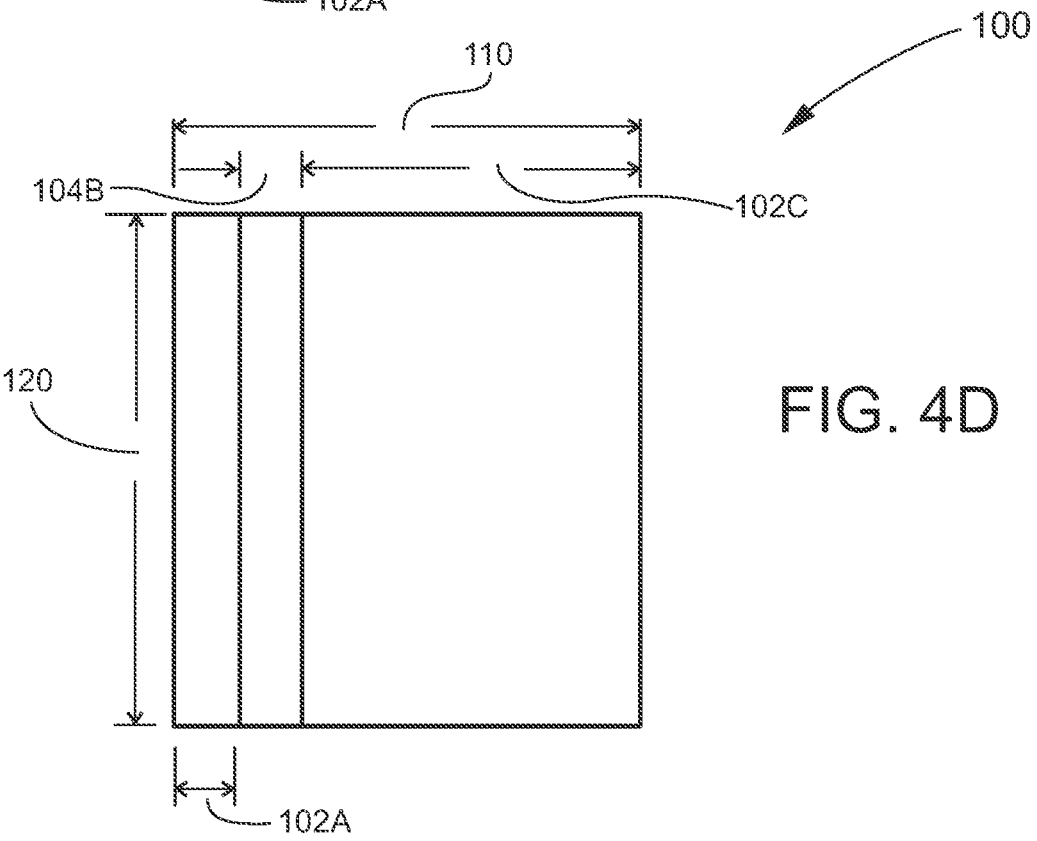
Figure 4E:
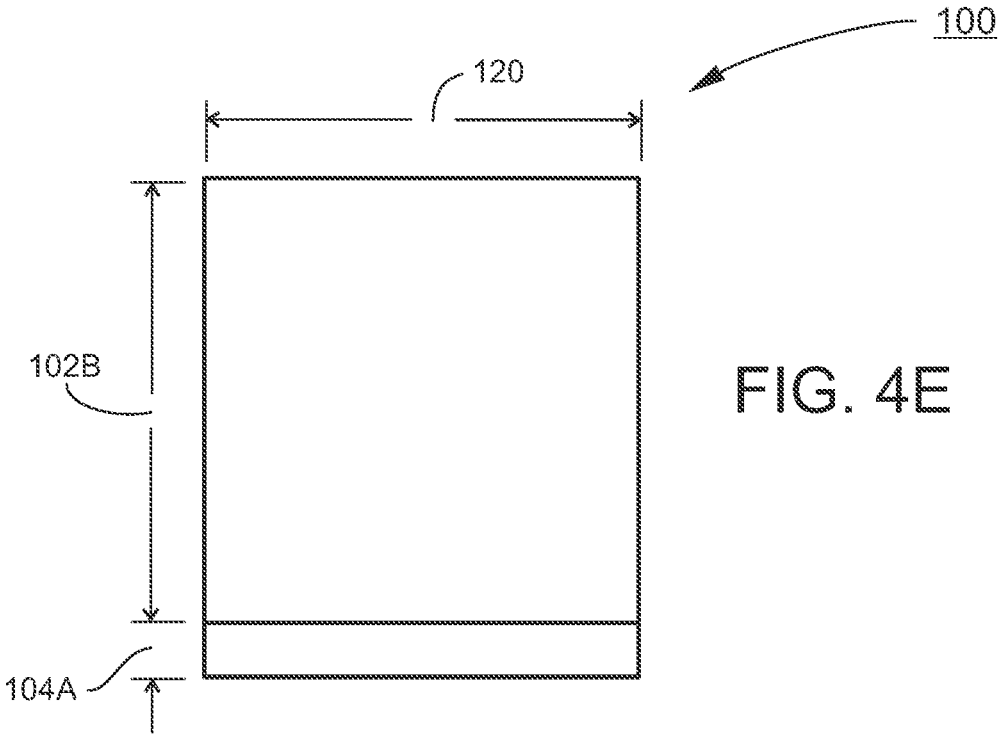
Figure 4F:
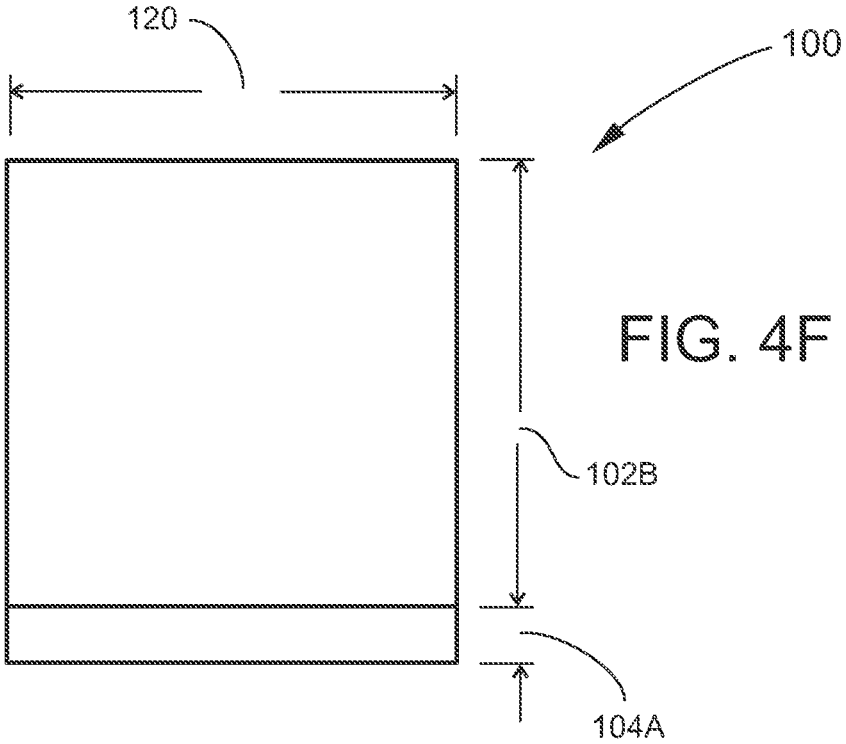
Figure 5:
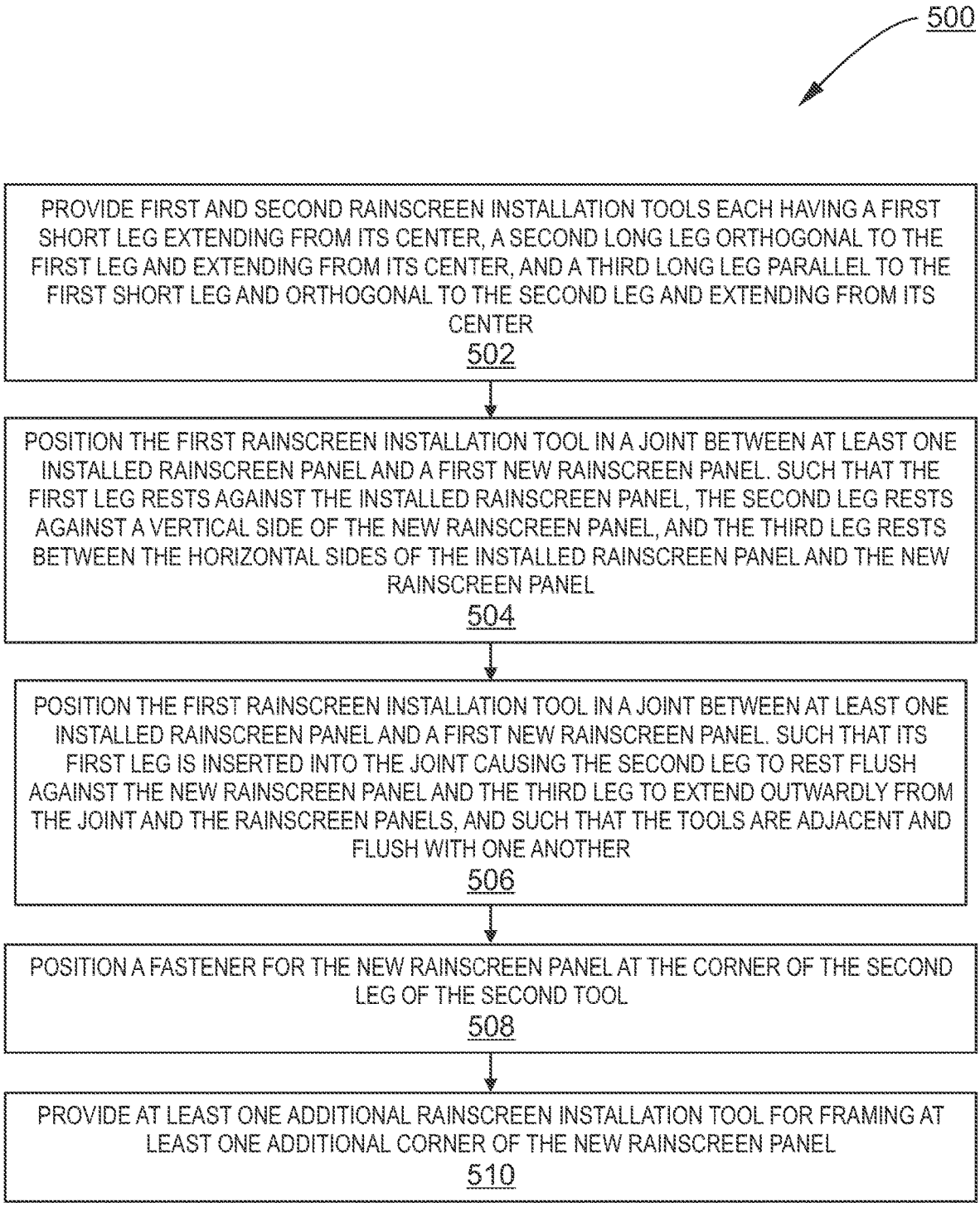
Figure 6:
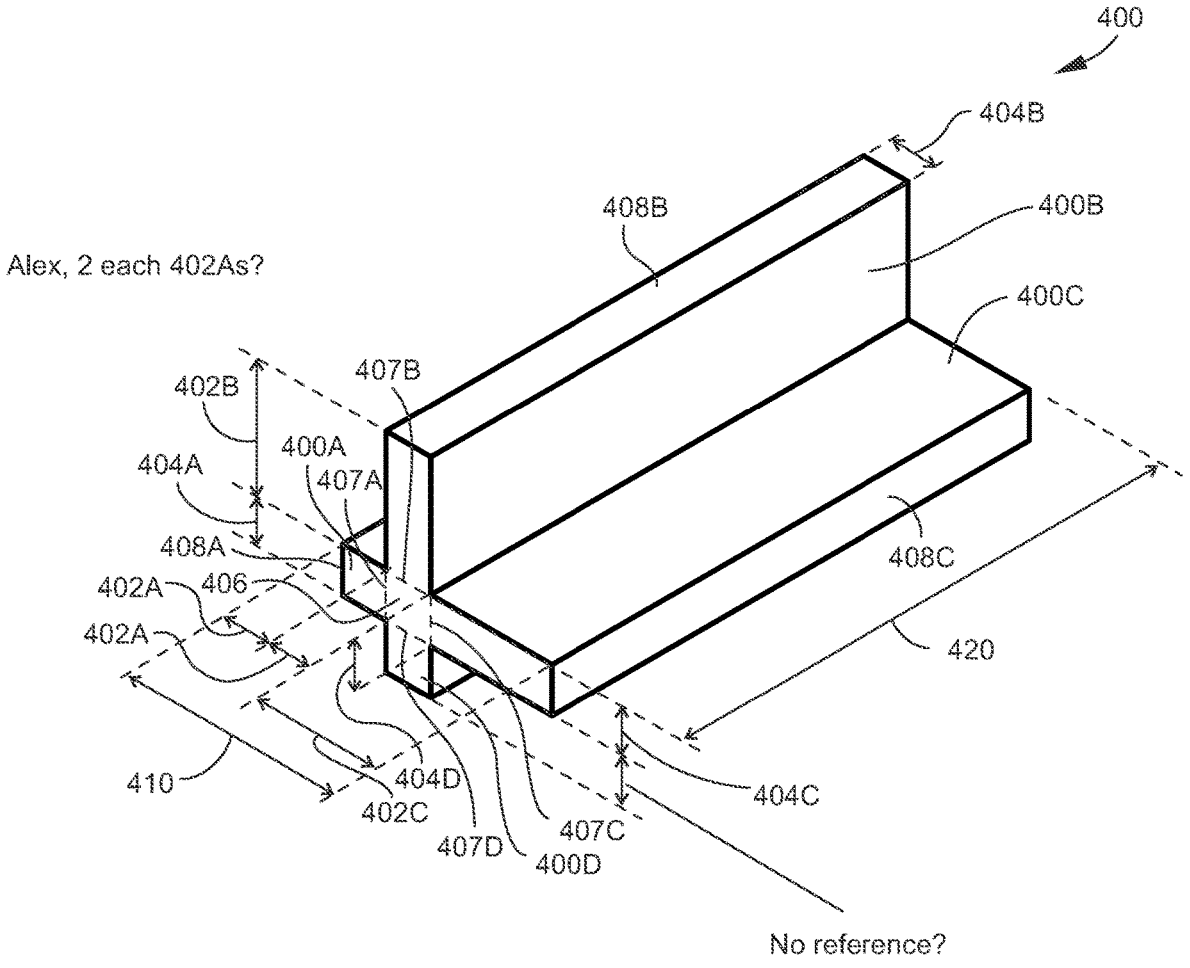
Figure 7:
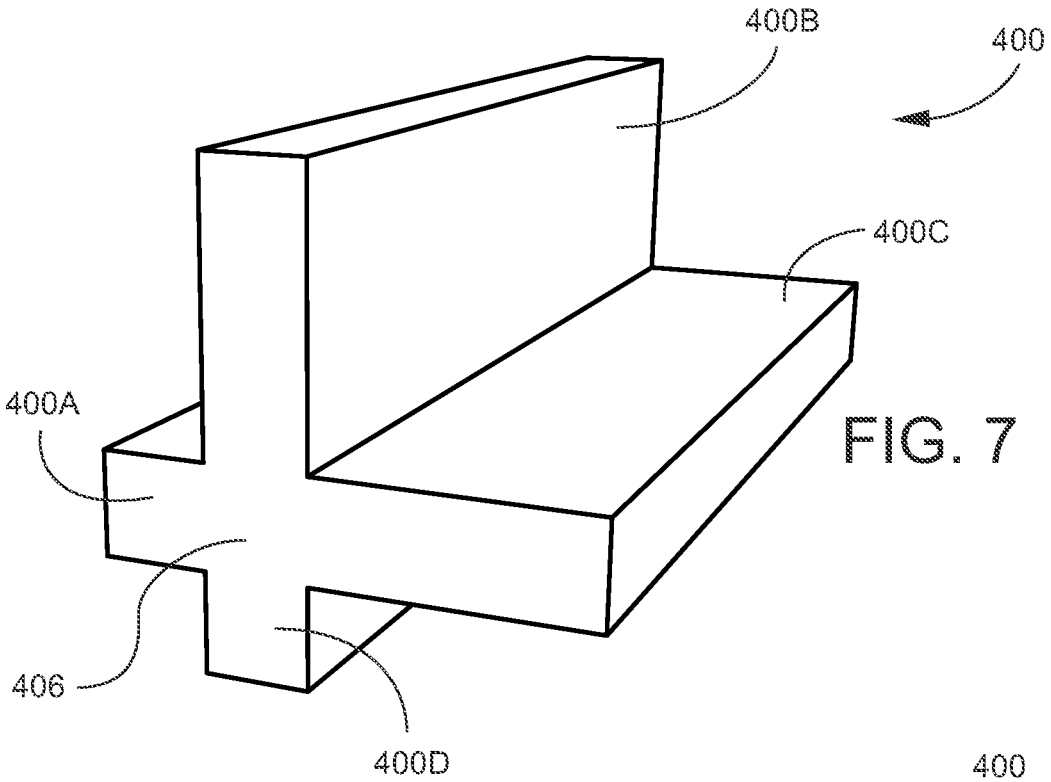
Figure 8:
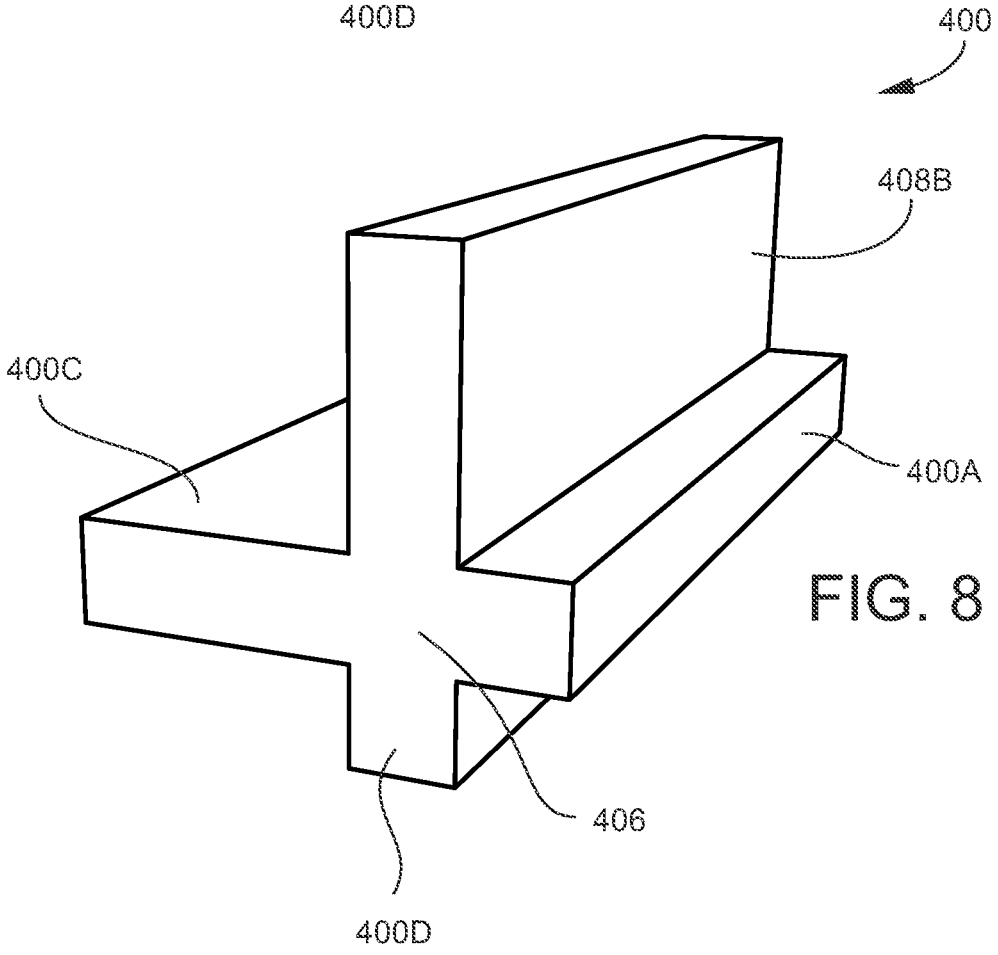
Figure 9:
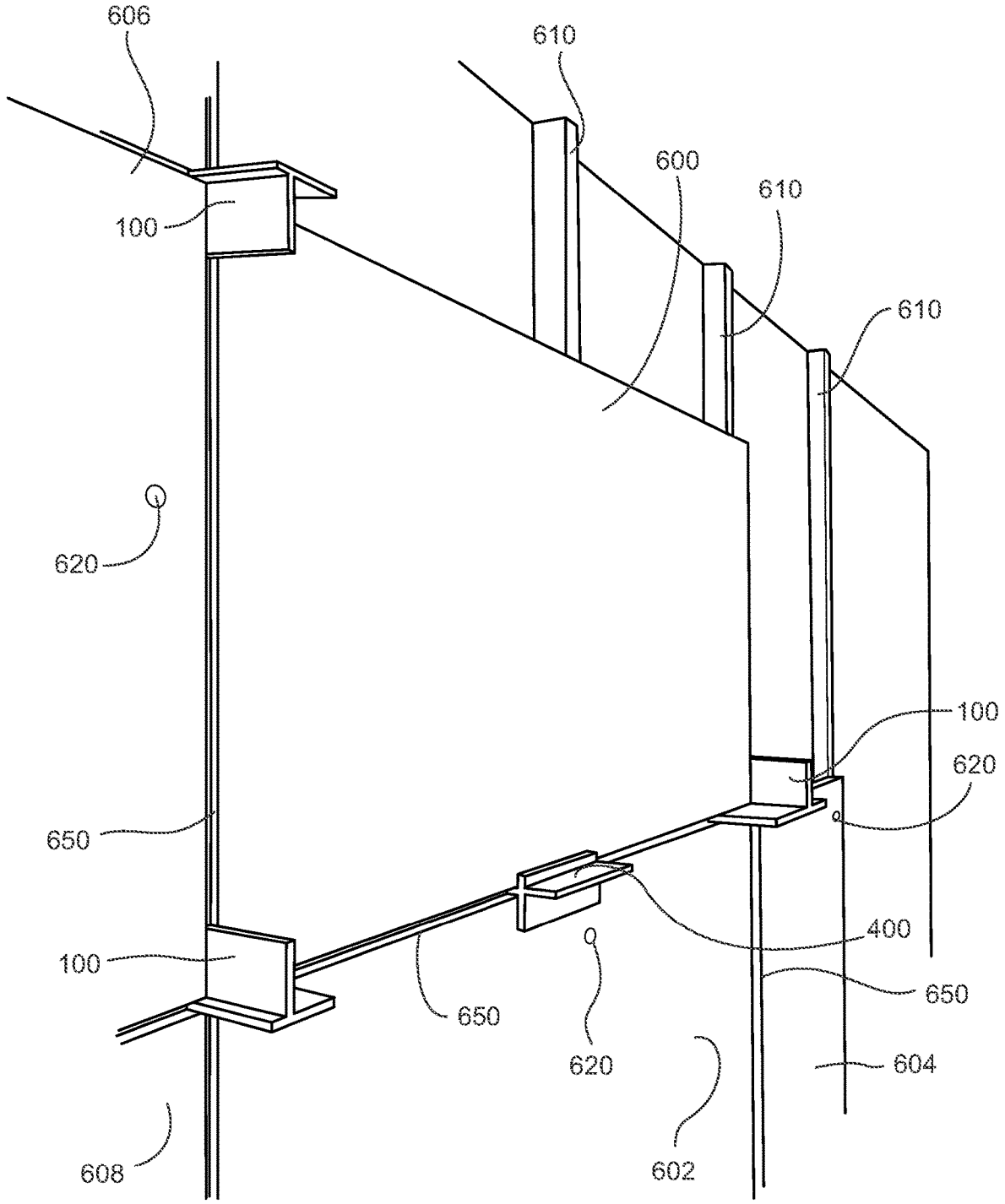
Figure 10:
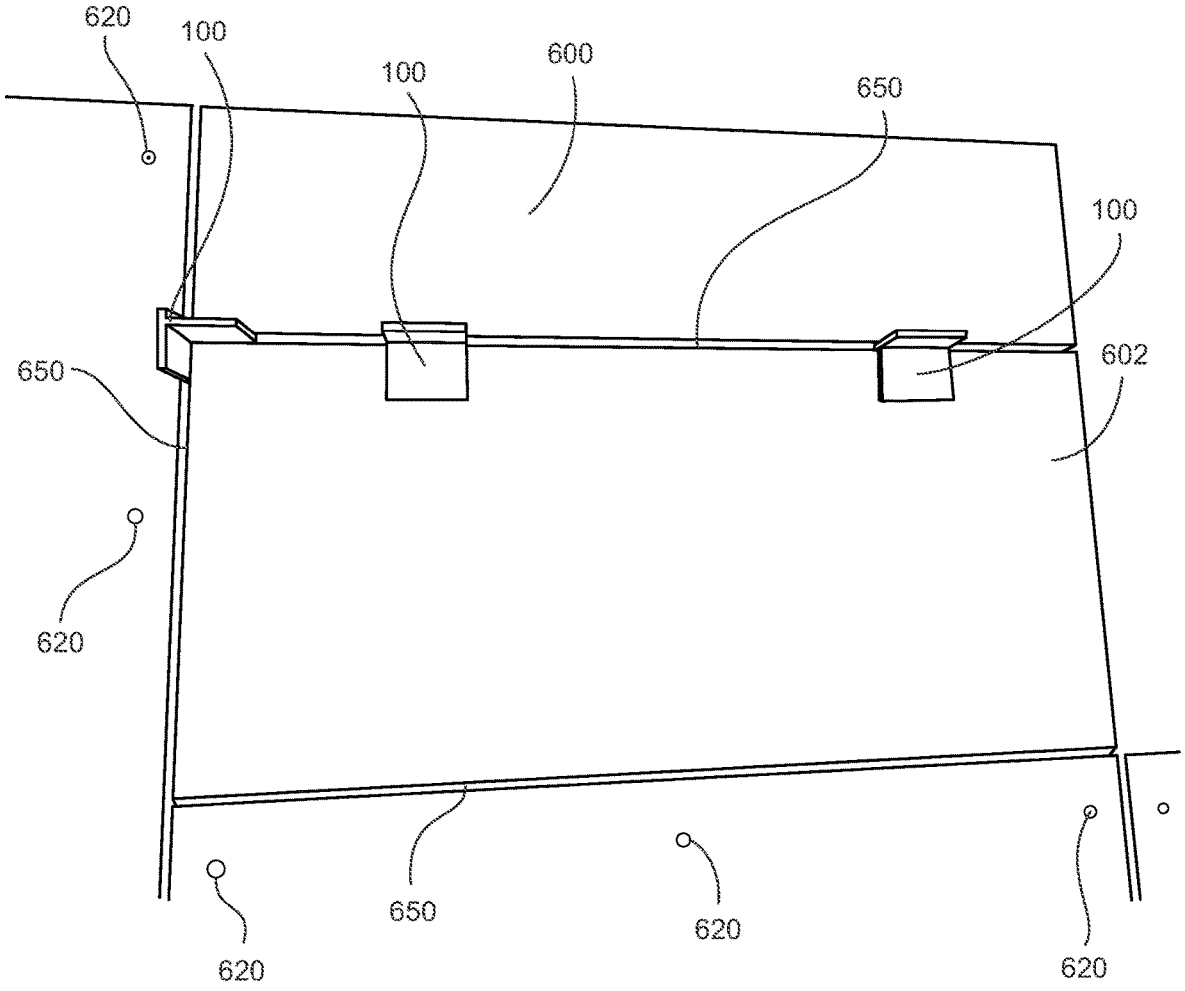
Figure 12:
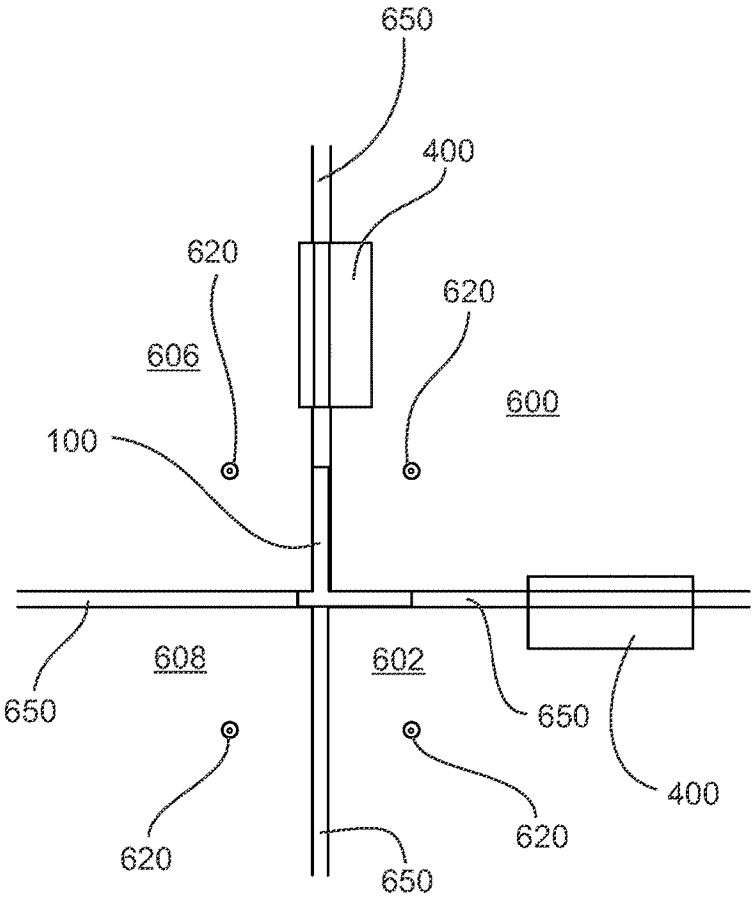
Figure 11:
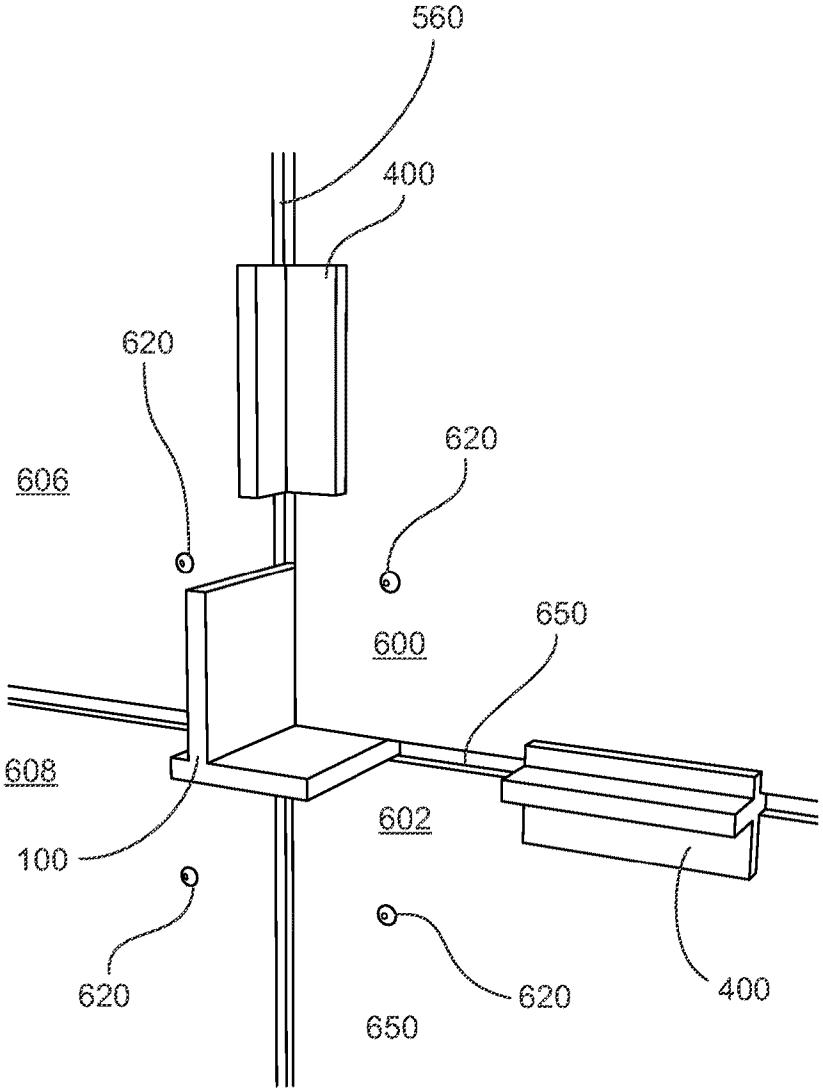
Figure 14:
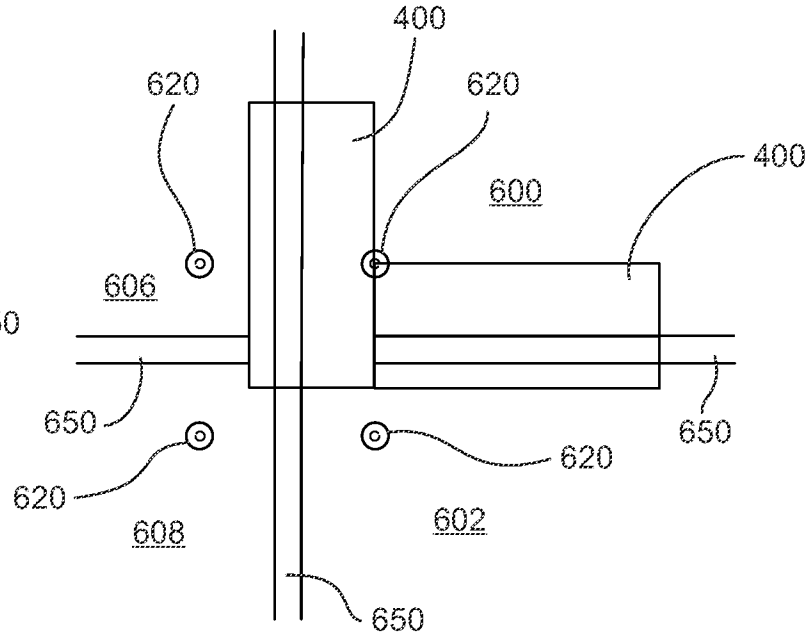
Figure 13:
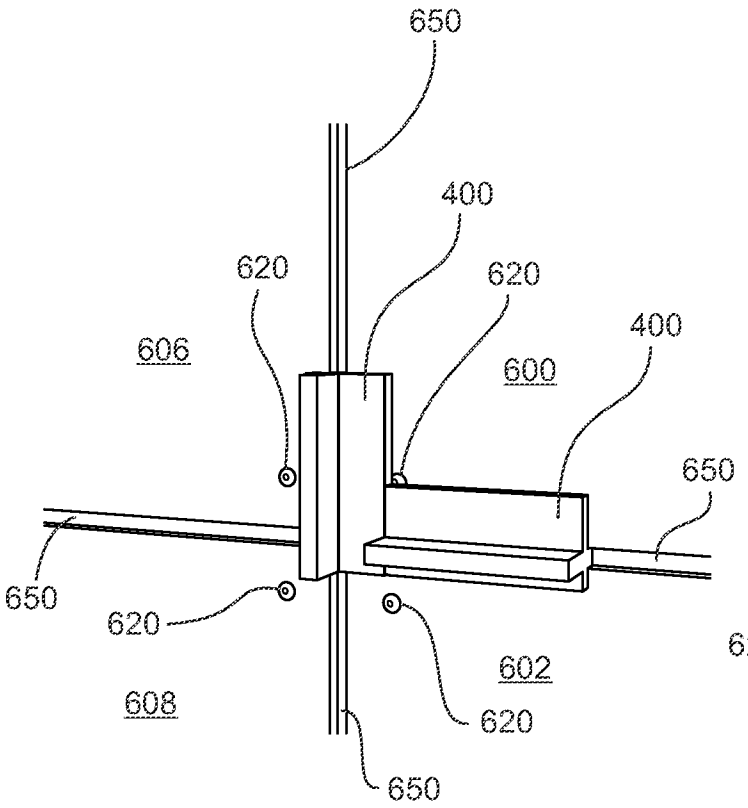
Figure 15:
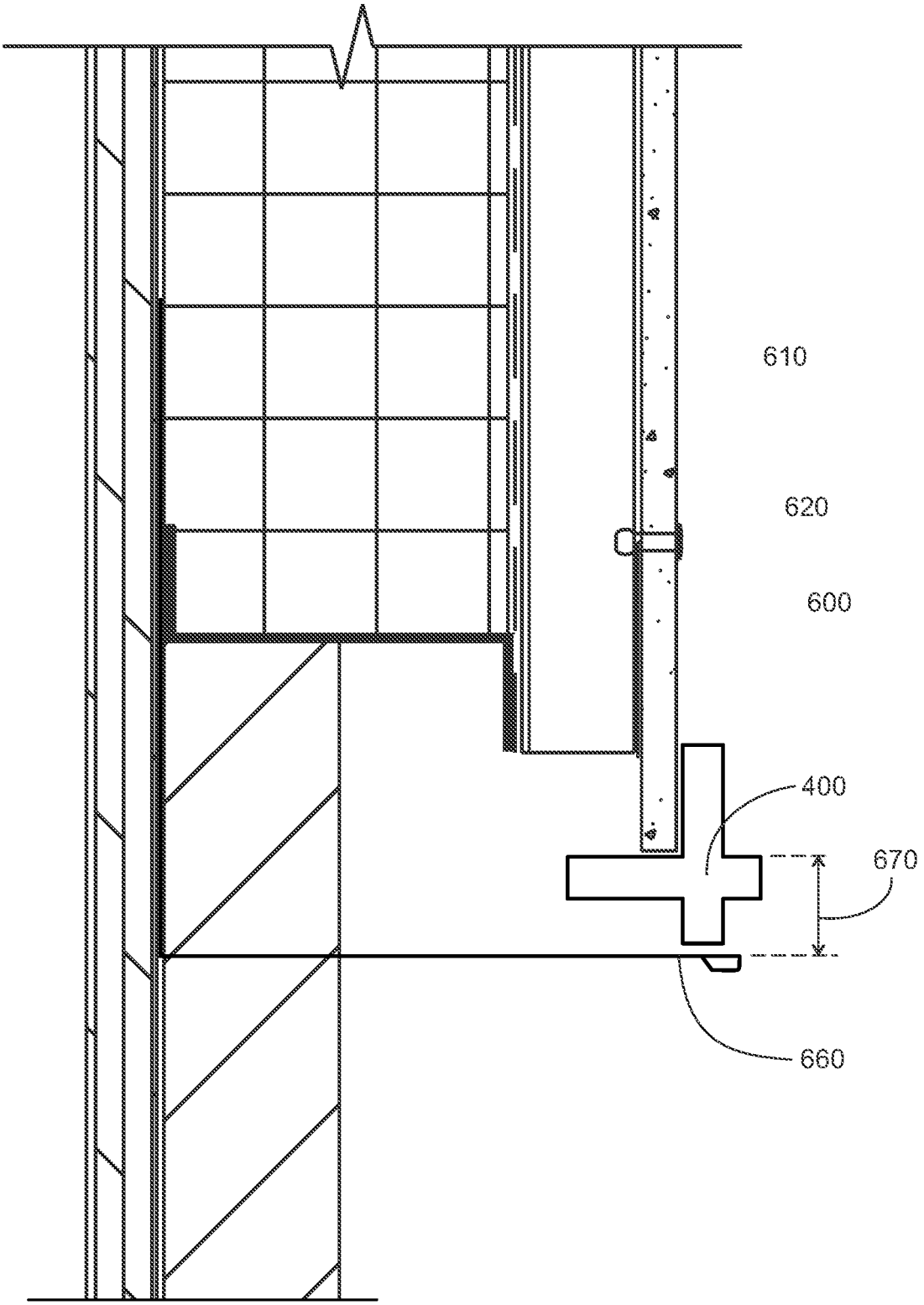
Figure 16:
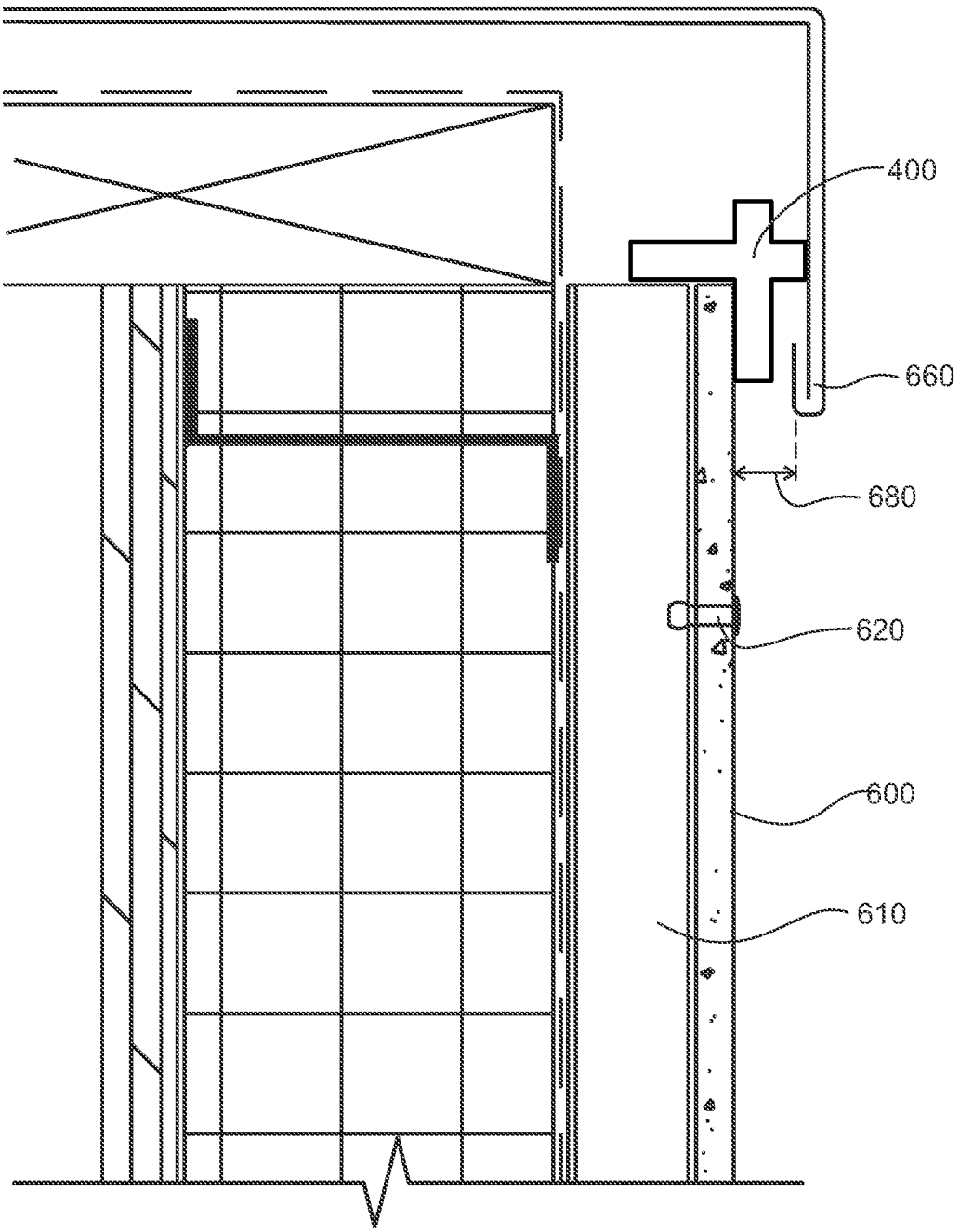

Having thus described the invention in general terms, reference will not be made to the accompanying drawings, in which:

FIG. 1 is an isomeric view of an embodiment of the invention;

FIG. 2A is an environmental view of an embodiment of the invention;

FIG. 2B is an environmental view of an embodiment of the invention;

FIG. 3A is an environmental view of an embodiment of the invention;

FIG. 3B is an environmental view of an embodiment of the invention;

FIG. 4A is a perspective view of an embodiment of the invention;

FIG. 4B is a perspective view of an embodiment of the invention;

FIG. 4C is a front view of an embodiment of the invention;

FIG. 4D is a top view of an embodiment of the invention;

FIG. 4E is a left view of an embodiment of the invention;

FIG. 4F is a right view of an embodiment of the invention;

FIG. 5 is a flow chart according to a method of the invention;

FIG. 6 is an isometric view of an embodiment of the invention;

FIG. 7 is a perspective view of an embodiment of the invention;

FIG. 8 is a perspective view of an embodiment of the invention;

FIG. 9 is an environmental view of an embodiment of the invention;

FIG. 10 is an environmental view of an embodiment of the invention;

FIG. 11 is an environmental view of an embodiment of the invention;

FIG. 12 is an environmental view of an embodiment of the invention;

FIG. 13 is an environmental view of an embodiment of the invention;

FIG. 14 is an environmental view of an embodiment of the invention;

FIG. 15 is an environmental view of an embodiment of the invention;

FIG. 16 is an environmental view of an embodiment of the invention; and

Figure 17:
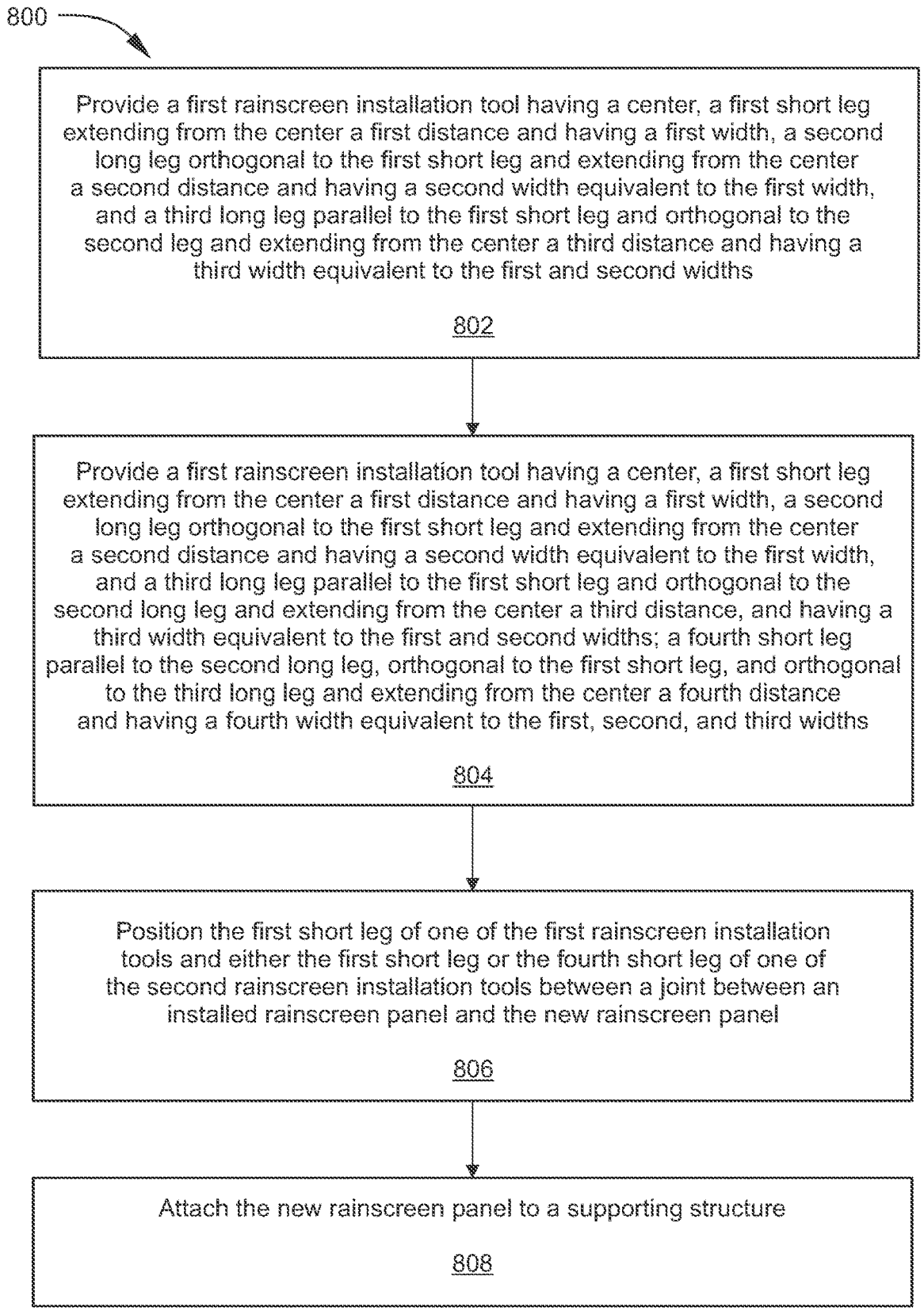

FIG. 17 is a flow chart according to a method of the invention.

DETAILED DESCRIPTION OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. Referring now to the drawings and the listing of machine components set out below, the invention according to an embodiment is described in further detail.

Embodiments of the invention provide a rainscreen installation tool 100, tool 400, method 500 (FIG. 5), and method 800 (FIG. 17) for using the tool to install rainscreens as shown in FIG. 1, which illustrates an isometric view of the tool from the front and right sides.

Referring generally to FIGS. 1-4, the rainscreen installation tool 100 may be an extruded tool designed to assist in providing spacing, measuring, and hanging assistance for open-jointed rainscreen panels. In some embodiments, the tools may be made from plastic, metal, ceramic, fiber, wood or plant based materials, or some composite of these materials.

In some embodiments, the tool includes three (3) legs 100A, 100B and 100C, each of which may be of varying lengths 102A, 102B and 102C. Their lengths may be subject to the specifications of the manufacturer providing the rainscreen panel(s). For the rainscreen tool 100, the lengths 102A, 102B and 102C most commonly utilized are measured respectively from the edges 107A, 107B and 107C of a center portion 106 of the tool 100 to the respective ends 108A, 108B and 108C of the legs 100A, 100B and 100C and vary from 1 inch to 3 inches, with the short leg's 100A length 102A typically being equal to its width 104A and 104C, which may correspond to the width of the rainscreen panel being installed. The center portion 106 is preferably a rectangular prism shape having a square cross section, and is called out, in this embodiment solely for illustration purposes. To be clear, in this embodiment, the sides 107A, 107B, 107C, and 107D of the center portion 106 are the same length, which is also the same as the widths 104A, 104B, and 104C of the legs 100A, 100B, and 100C, respectively, and the length 102A of leg 100A. The center portion 106 is typically not a separate component or piece of the tool 100, but rather, the tool 100 is a unitary body including the center portion 106, leg 100A extending from edge 107A of the center portion 106, leg 100B extending from edge 107B of the center portion 106, and leg 100C extending from edge 107C of the center portion 106.

The width 104A, 104B and 104C of each leg is also subject to the rainscreen manufacturer's specifications. The widths 104A, 104B and 104C most commonly utilized are 6 mm to 10 mm in metric and 5/16 inch to ½ inch in imperial or standard. The overall length 110 of the tool 100 is variable but is most commonly cut into a minimum length of 4 inches as to give enough material to get a hand hold when removing the tool from between the panels after their installation. The overall length 110 is the sum of the short leg's 100A length 102A, leg's 100C length 102C, and center portion 106 side 104D.

FIG. 2A shows an isometric view of how the tool 100 is used to provide a spacing and weight support of the panels 200A and 200B being installed. The tool 100 will rest on previously installed panel(s) 210 situated below the tool 100, and provides a guide for the two panels 200A and 200B that rest on the tool 100 during their installation. With the tool 100 depth 120 being equal on all legs 100A, 100B and 100C, any part of the tool 100 can be inserted into any portion of the open gaps 220 between the rainscreen panels 200A, 200B and 210. In fact, in a situation where four rainscreen panels form a "cross" joint having gaps 220 extending in four directions, the tool 100 can be inserted in four orthogonal (4) orientations by rotation clockwise 230 or counterclockwise 235 as shown in FIG. 2B. The tool 100 can be used at the corners where panels 200A, 200B meet as shown, but also in the center of panels 200A, 200B to provide weight support and remove deflection. As shown in FIGS. 2A and 2B, leg 100C extends distally from the center 106 of the tool 100 a length 102C that corresponds to the distance 240 of the fastener 250 on the top right panel 200B from the vertical panel joint 220B. Leg 100B extends distally and vertically from the center 106 of the tool 100 a length 102B that corresponds to the distance 242 from panel joint 220C of the fasteners 250 and 252 on the two top panels 200A and 200B from the horizontal panel joint 220A/220C.

FIG. 2B shows frontal view of how the tool 100 is used to provide a spacing and weight support of the panels 200A, 200B being installed. The tool 100 will rest on the panels 210 below it that have already been installed, and provide a guide for the two panels 200A, 200B that rest on the tool 100. With the tool 100 depth being equal on all legs 100A, 100B, 100C, any part of the tool 100 can be inserted into any portion of the open joint 220C of the rainscreen panel. It can be used at the corners as shown, but also in the center of panels to provide weight support and remove deflection. This figure also shows how the bottom leg extending to the right 100C corresponds to the distance of the fastener 240 on the top right panel 200B from the vertical panel joint 220C. The figure also shows how the top leg 100B extending upwards from the base corresponds to the distance of the fastener 250, 252 on the two top panels 200A, 200B from the horizontal panel joint 220C.

FIG. 3A shows an isometric view of how two rainscreen resource tools 300A, 300B can be used to find the exact location of the fasteners on a rainscreen panel. The tool on the left is placed into the open joints of the rainscreen 200A, 200B. The bottom right leg is designed to measure the exact distance from the vertical panel joint that the manufacturer of the rainscreen panel recommends for their fastener location. The tool on the right is then inserted by placing the short leg into the open joint of the rainscreen, located directly adjacent and butted to the right leg being used to measure the distance from the vertical panel joint. The second tool will then be sitting flush to the panel, and the leg designed to be the same length as the distance designated by the panel manufacturer for their fastener from the horizontal joint will designate the screw location. In the diagram, it would be the top left corner of the second tool provides the horizontal and vertical coordinates of the screw and designates its location with its top left corner.

FIG. 3B shows a front view of how two rainscreen tools 300A and 300B can be used to find the exact location of the fasteners on a rainscreen panel. The tool 300A on the left is placed into the open joints of the rainscreen. The bottom right leg is designed to measure the exact distance from the vertical panel joint that the manufacturer of the rainscreen panel recommends for their fastener location. As shown, the tools length and width are machined to measure 2 inches in one direction and 3 inches in another direction. The tool 300B on the right is then inserted by placing the short leg into the open joint of the rainscreen, located directly adjacent and butted to the right leg being used to measure the distance from the vertical panel joint. The second tool 300B will then be sitting flush to the panel, and the leg designed to be the same length as the distance designated by the panel manufacturer for their fastener from the horizontal joint will designate the screw location. In the diagram, it would be the top left corner of the second tool 300B that provides the horizontal and vertical coordinates of the screw and designates its location with its top left corner.

FIG. 4A shows a front right perspective drawing of the tool 100.

FIG. 4B shows a rear left perspective of the tool 100.

FIG. 4C shows the front view of the tool 100. In this figure, 102A, 104B will be equal to the thickness of the open-joint rainscreen panel being installed and the length of the leg extending left of the center base. The leg extending from the base of the tool 100 and rising upwards has a length equal to the suggested distance from the edge of the horizontal joint of the rainscreen panel to the fastener location. These distances are found in the specifications and installation guides of the manufacturers of the panel systems.

FIG. 4D shows a top view of the tool 100. It shows the length of the short leg being equal to the width of the upward facing leg. This is so the short leg can be inserted in the open joint and will insert to a depth equal to the rainscreen panel width. In this figure, 102A, 104B will be the same and will be the equal to the thickness of the open-joint rainscreen panel being installed. The leg extending from the center of the tool and to the right of the intersection has a length equal to the suggested distance from the edge of the vertical joint of the rainscreen panel to the fastener location. These distances are found in the specifications and installation guides of the manufacturers of the panel systems. The distance 120 may vary based on the installer's preference. If pre-cut, the distance 120 will be cut into hand-tool lengths with the intent that an installer may apply leverage on the tool to remove it from the rainscreen panels after their weight has been placed onto the tool and the panel has been installed into place. This length 120 could also be as long as the rainscreen panels and used in a continuous fashion with lengths upwards of eight feet, ten feet, and twelve feet.

FIG. 4E shows the left view of the tool 100. The leg extending from the base of the tool and rising upwards has a length 102B equal to the suggested distance from the edge of the horizontal joint of the rainscreen panel to the fastener location. These distances are found in the specifications and installation guides of the manufacturers of the panel systems. In this figure, 104A will be equal to the thickness of the open-joint rainscreen panel being installed. The distance labeled, 120 varies based on the installer's preference. If pre-cut, it will be cut into hand-tool lengths with the intent that an installer may apply leverage on the tool to remove it from the rainscreen panels after their weight has been placed onto the tool and the panel has been installed into place. This length could also be as long as the rainscreen panels and used in a continuous fashion with lengths upwards of eight feet, ten feet, or twelve feet.

FIG. 4F shows the right view of the tool 100. The leg extending from the base of the tool and rising upwards has a length 102B equal to the suggested distance from the edge of the horizontal joint of the rainscreen panel to the fastener location. These distances are found in the specifications and installation guides of the manufacturers of the panel systems. In this figure, 104A will be equal to the thickness of the open-joint rainscreen panel being installed. The distance labeled, 120 varies based on the installer's preference. If pre-cut, it will be cut into hand-tool lengths with the intent that an installer may apply leverage on the tool to remove it from the rainscreen panels after their weight has been placed onto the tool and the panel has been installed into place. This length could also be as long as the rainscreen panels and used in a continuous fashion with lengths upwards of eight feet, ten feet, or twelve feet.

FIG. 5 shows a flowchart illustrating a method 500 for using the rainscreen tool for installing rainscreen panels. The first step of the method 500 is to provide first and second rainscreen installation tools each having a first short leg extending from a center portion, a second long leg orthogonal to the first leg and extending from its center portion, and a third long leg parallel to the first short leg and orthogonal to the second leg and extending from its center portion, as represented by block 502.

In various embodiments or applications of the method, rainscreen installation tools 100 are used (i) at only one corner of the rainscreen panel being installed, (ii) at two corners of the rainscreen panel being installed, (iii) at three corners of a rainscreen panel being installed, or (iv) at all four corners of a rainscreen panel being installed. In some applications, the method is referred to as "framing" a new rainscreen panel being installed in that the rainscreen installation tools provide positioning (i.e., framing) for the rainscreen panel being installed. During installation of a rainscreen system, several tools 100 may be used for each rainscreen panel to keep the installation properly framed during installation.

The next step is to position the first tool in a joint between an installed rainscreen panel and a new rainscreen panel. This is done such that the first leg rests against the installed rainscreen panel, the second leg rests against a vertical side of the new rainscreen panel, and the third leg rests between the horizontal sides of the installed rainscreen panel and the new rainscreen panel, as represented by block 504.

The next step (which in some embodiments or applications is an optional step) is to position the second tool adjacent the first tool so that they are flush with one another. The second tool should be positioned in the joint between the installed rainscreen panel and the new rainscreen panel so that its first leg is inserted into the joint causing the second leg to rest flush against the new rainscreen panel and the third leg to extend outwardly from the joint and both rainscreen panels, as represented by block 506.

The next step (which in some embodiments or applications is also optional with step 506), as represented by block 508, is to position a fastener for the new rainscreen panel at the corner of the second leg of the second tool.

In various applications of the method 500, multiple (all) fasteners for a new rainscreen panel may be installed using rainscreen tool(s) in a process similar to that discussed above.

The last step of FIG. 5, represented by block 510, is to provide at least one additional rainscreen installation tool for framing at least one additional corner of the new rainscreen panel. This step is an optional step and may be repeated for second, third and/or fourth corners of the new rainscreen panel being installed. As noted above, this process may be referred to as "framing" the rainscreen panel. In some embodiments, four rainscreen installation tools are used to frame the corners of the rainscreen panel being installed and at least one additional rainscreen installation tool is used as shown in FIGS. 3A and 3B for positioning of fasteners.

Referring generally now to FIGS. 6-8, in additional embodiments, the tool includes four (4) legs 400A, 400B, 400C and 400D, each of which may be of varying lengths 402A, 402B, 402C, and 402D. Their lengths may be subject to the specifications of the manufacturer providing the rainscreen panel(s). For the rainscreen tool 400, the lengths 402A, 402B, 402C, and 402D most commonly utilized are measured respectively from the edges 407A, 407B, 407C, and 407D of a center portion 406 of the tool 400 to the respective ends 408A, 408B, 408C, and 408D of the legs 400A, 400B, 400C, and 400D and vary from 1 inch to 3 inches, with the short leg's 400A length 402A typically being equal to its width 404A and 404C, which may correspond to the width of the rainscreen panel being installed. The center portion 406 is preferably a rectangular prism shape having a square cross section, and is called out, in this embodiment solely for illustration purposes. To be clear, in this embodiment, the sides 407A, 407B, 407C, and 407D of the center portion 406 are the same length, which is also the same as the widths 404A, 404B, 404C and 404D of the legs 400A, 400B, 400C, and 400D, respectively, and the length 402A of leg 400A. The center portion 406 is typically not a separate component or piece of the tool 400, but rather, the tool 400 is a unitary body including the center portion 406, leg 400A extending from edge 407A of the center portion 406, leg 400B extending from edge 407B of the center portion 406, leg 400C extending from edge 407C and leg 400D extending from edge 407D of the center portion 406.

The width 404A, 404B, 400C, and 404D of each leg is also subject to the rainscreen manufacturer's specifications. The widths 404A, 404B, 400C, and 404D most commonly utilized are 6 mm to 10 mm in metric and 5/16 inch to ½ inch in imperial or standard. The overall length 410 of the tool 400 is variable but is most commonly cut into a minimum length of 3 inches as to give enough material to get a hand hold when removing the tool from between the panels after their installation. The overall length 410 is the sum of the short leg's 400A length 402A, leg's 400C length 402C, and center portion 406 side 404D.

FIGS. 9-14 are environmental views showing how the tools 100 and 400 may be used to provide a spacing and weight support of the panels 600, 602, 604, 606, and 608 being installed. The panels are installed via fasteners 620 to supporting structure 610. The tools 100, 400 will rest on previously installed panel(s) 602, 608, 604 situated below the tools 100, 400, and provides a guide for the two panels 600, 606 that rest on the tools 100, 400 during their installation. With the tool 400 depth 404A, 404B, 404C, and 404D being equal on all legs 400A, 400B, 400C and 400D, any part of the tool 400 can be inserted into any portion of the open gaps 650 between the rainscreen panels 600, 602, 604, 606, and 608. In fact, in a situation where four rainscreen panels form a "cross" joint having gaps 650 extending in four directions, the tool 400 can be inserted in four orthogonal (4) orientations by rotation clockwise or counterclockwise. The tool 400 can be used at the corners where panels 606 and 608 meet as shown, but also in the center of panels 600 and 602 to provide weight support and remove deflection.

FIG. 10 shows frontal view of how the tool 100 is used to provide a spacing and weight support of the panels being installed. The tool 100 will rest on the panels below it that have already been installed, 602 and provide a guide for the panel 600 that rest on the tool. With the tool depth being equal on all legs, any part of the tool 100 can be inserted into any portion of the open joint of the rainscreen panel. In particular, FIG. 10 highlights that tool 100 can be used at a joint of three panels as may occur in a running bond pattern. The tool may be used at the corners as shown, but also in the center of panels to provide weight support and remove deflection.

FIG. 11, FIG. 12, FIG. 13, and FIG. 14 show how tools 100 and 400 may be used to install panels 600, 602, 606, and 608. The panels 600, 602, 606, and 608 are separated via joint 650 and are attached to supporting structure via fastener 620 which may be a screw. As shown in FIGS. 13 and 14, fastener 620 is positioned in a corner where tools 400 and 400 meet at a right angle. Tool 400 may be machined to accommodate this arrangement.

FIG. 15 and FIG. 16 show an environmental view of the tool 400 may be used to provide minimum spacing for air venting at the top and bottom of a rainscreen wall assembly.

As shown in FIG. 16, the tool 400 will rest on top of the final rainscreen panel 600 which is attached to supporting structure 610 via fastener 620. Leg 400A is oriented in such a manner that it is pointed vertically upward and leg 400D is pointed away from the rainscreen panel 600. 400B will be pointed toward the supporting structure 610, and 400C will be flush against the face of the final rainscreen in a column of panels. The combination of the thickness 406 and the length of 400A gives the minimum distance that a coping or flashing 660 may be placed above an open-joint rainscreen panel. The combination of the thickness of 406 and 400D gives the minimum distance 680 that a coping or flashing 660 may be placed to the face of a rainscreen panel 600.

FIG. 15 shows an isometric view of the tool is used to provide minimum spacing for air venting at the bottom of each rainscreen 600 wall assembly. The tool 400 will be rested on top of the kick out flashing 660 at the base wall condition of a rainscreen assembly. Legs 400A is oriented in such a manner that it is pointed vertically downward and leg 400D is pointed away from the rainscreen panel. 400B will be pointed toward the substrate, and 400C will flush against the face of the first rainscreen panel in a column of panels. The combination of the thickness 406 and the length of 400A gives the minimum distance that an open-joint rainscreen panel can be installed above the flashing member 660.

FIG. 17 shows a flowchart illustrating a method 800 for using the rainscreen tool 100, 400 for installing rainscreen panels 600. The first step 802 of the method 800 is to provide a first rainscreen installation tool having a center, a first short leg extending from the center a first distance and having a first width, a second long leg orthogonal to the first short leg and extending from the center a second distance and having a second width equivalent to the first width, and a third long leg parallel to the first short leg and orthogonal to the second leg and extending from the center a third distance and having a third width equivalent to the first and second widths.

A second step 804 is to provide a second rainscreen installation tool having a center; a first short leg extending from the center a first distance and having a first width; a second long leg orthogonal to the first short leg and extending from the center a second distance and having a second width equivalent to the first width; a third long leg parallel to the first short leg and orthogonal to the second long leg and extending from the center a third distance and having a third width equivalent to the first and second widths; a fourth short leg parallel to the second long leg, orthogonal to the first short leg, and orthogonal to the third long leg and extending from the center a fourth distance and having a fourth width equivalent to the first, second, and third widths.

A third step 806 is to position the first short leg of one of the first rainscreen installation tools and either the first short leg or the fourth short leg of one of the second rainscreen installation tools between a joint between an installed rainscreen panel and the new rainscreen panel.

A fourth step 808 is to attach the new rainscreen panel to a supporting structure.

According to some embodiments of the invention, a rainscreen installation tool and method for installing rainscreen panels using the tool are disclosed.

Although embodiments of the invention described herein are generally described as involving a manufacturing entity, it will be understood that this invention may involve one or more persons, organizations, businesses, merchants and/or other institutions, services providers or the like that implement one or more steps, one or more processes, and/or one or more portions of one or more of the embodiments described and/or contemplated herein, and/or or one or more steps or processes not described herein.

While the foregoing disclosure discusses illustrative embodiments, it should be noted that various changes and modifications could be made herein without departing from the scope of the described aspects and/or embodiments as defined by the appended claims. Additionally, all or a portion of any embodiment may be utilized with all or a portion of any other embodiment, unless stated otherwise. Furthermore, while certain exemplary embodiments have been described and shown in the accompanying drawings, it is to be understood that such embodiments are merely illustrative of and not restrictive on the broad invention, and that this invention is not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

Although many embodiments of the invention have just been described above, the invention may be embodied in many different forms and should not be construed as limited to the embodiments set forth herein; rather, these embodiments are provided so that this disclosure will satisfy applicable legal requirements. It will also be understood that where possible, any of the advantages, features, functions, devices, and/or operational aspects of any of the embodiments of the invention described and/or contemplated herein may be included in any of the other embodiments of the invention described and/or contemplated herein, and/or vice versa. In addition, where possible, any terms expressed in the singular form herein are meant to also include the plural form and/or vice versa, unless explicitly stated otherwise.

What is claimed is:

1. A method for installing a rainscreen panel using rainscreen installation tools, the method comprising:

providing identical first and second rainscreen installation tools each having a first short leg extending from its center, a second long leg orthogonal to the first leg and extending from its center, and a third long leg parallel to the first short leg and orthogonal to the second leg and extending from its center;

positioning the first tool in a joint between an installed rainscreen panel and a new rainscreen panel such that the first short leg rests against the installed rainscreen panel and an end of the first short leg is in contact with a supporting structure, the second leg rests against a vertical side of the new rainscreen panel, and the third leg rests between the horizontal sides of the installed rainscreen panel and the new rainscreen panel;

positioning the second tool in the joint between the installed rainscreen panel and the new rainscreen panel so that its first short leg is inserted into the joint causing the second leg to rest flush against the new rainscreen panel and the third leg to extend outwardly from the joint and both rainscreen panels; and installing the new rainscreen panel.

2. The method for installing a rainscreen panel using rainscreen installation tools of claim 1 further comprising the steps of:

positioning the second tool adjacent the first tool so that they are flush with one another; and positioning a fastener for the new rainscreen panel at a top corner of the second leg of the second tool.

3. The method for installing a rainscreen panel using rainscreen installation tools of claim 1 wherein the first short leg has a length equal to a thickness of the new rainscreen panel and wherein a thickness of the second long leg and a thickness of the third long leg is equal to the length of the first short leg.

4. The method for installing a rainscreen panel using rainscreen installation tools of claim 3 wherein the second long leg has a length equal a distance adjacent the joint for placement of a fastener.

5. The method for installing a rainscreen panel using rainscreen installation tools of claim 3 wherein the third long leg has a length equal to a distance adjacent the joint for placement of a fastener.

6. A method for installing a new rainscreen panel comprising the steps of:

providing a plurality of first rainscreen installation tools, each of the first rainscreen installation tools having: a center; a first short leg extending from the center a first distance and having a first width; a second long leg orthogonal to the first short leg and extending from the center a second distance and having a second width equivalent to the first width; and a third long leg parallel to the first short leg and orthogonal to the second leg and extending from the center a third distance and having a third width equivalent to the first and second widths;

providing a plurality of second rainscreen installation tools, each of the second rainscreen installation tools having: a center; a first short leg extending from the center a first distance and having a first width; a second long leg orthogonal to the first short leg and extending from the center a second distance and having a second width equivalent to the first width; a third long leg parallel to the first short leg and orthogonal to the second long leg and extending from the center a third distance and having a third width equivalent to the first and second widths; a fourth short leg parallel to the second long leg, orthogonal to the first short leg, and orthogonal to the third long leg and extending from the center a fourth distance and having a fourth width equivalent to the first, second, and third widths;

positioning the first short leg of one of the first rainscreen installation tools and either the first short leg or the fourth short leg of one of the second rainscreen installation tools between a joint between an installed rainscreen panel and the new rainscreen panel; and attaching the new rainscreen panel to a supporting structure.

7. The method for installing a rainscreen panel of claim 6 wherein:

the first, second, and third widths of the first rainscreen installation tools is equal to the first, second, third, and fourth widths of the second rainscreen installation tools;

the first, second, and third widths of the first rainscreen installation tools and the first, second, third, and fourth widths of the second rainscreen installation tools is equal to a thickness of the joint.

8. The method for installing a rainscreen panel of claim 7 wherein:

the first distance of the first rainscreen installation tools is equal to the first and fourth distances of the second rainscreen installation tools; and the first distance of the first rainscreen installation tool and the first and fourth distances of the second rainscreen installation tools is equal to a thickness of the new rainscreen panel.

9. The method for installing a rainscreen panel of claim 8 further comprising the steps of:

positioning either the first short leg or the fourth short leg of another one of the plurality of second rainscreen installation tools in a joint between the new rainscreen panel and a second installed rainscreen panel such that the joint between the new rainscreen panel and the second installed rainscreen panel is orthogonal to the joint between the installed rainscreen panel and the new rainscreen panel;

further positioning the one of the plurality of second rainscreen installation tools so that the center of the second rainscreen installation tool abuts the edge of one of the legs the another one of the plurality of second rainscreen installation tools; and positioning the fastener into the new rainscreen panel at a corner where the one of the plurality of second rainscreen installation tools meets the another one of the plurality of second rainscreen installation tools.

10. A method for installing a plurality of rainscreen panels comprising the steps of:

providing a plurality of first rainscreen installation tools, each of the first rainscreen installation tools having: a center; a first short leg extending from the center a first distance and having a first width equivalent to the first distance; a second long leg orthogonal to the first short leg and extending from the center a second distance and having a second width equivalent to the first width; and a third long leg parallel to the first short leg and orthogonal to the second leg and extending from the center a third distance and having a third width equivalent to the first and second widths;

providing a plurality of second rainscreen installation tools, each of the second rainscreen installation tools having: a center; a first short leg extending from the center a first distance and having a first width equivalent to the first distance; a second long leg orthogonal to the first short leg and extending from the center a second distance and having a second width equivalent to the first width; a third long leg parallel to the first short leg and orthogonal to the second long leg and extending from the center a third distance and having a third width equivalent to the first and second widths; a fourth short leg parallel to the second long leg, orthogonal to the first short leg, and orthogonal to the third long leg and extending from the center a fourth distance and having a fourth width equivalent to the first, second, and third widths;

providing a plurality of rainscreen panels each of the plurality of rainscreen panels having at least two edges which join at a right angle;

attaching a first one of the plurality of rainscreen panels to a supporting structure;

positioning one of the second rainscreen installation tools so that: the center is in contact with the supporting structure; one of the legs of the second rainscreen installation tools rests on a top edge of the at least two edges of the first one of the plurality of rainscreen panels; and another one of the legs of the second rainscreen installation tool is in contact with an adjacent edge of the at least two edges of the first one of the plurality of rain screen panels;

positioning one of the first rainscreen installation tool so that: the first short leg rests on the top edge of the at least two edges of the first one of the plurality of rainscreen panels and the second long leg is in contact with an outer surface of the first one of the plurality of rainscreen panels;

positioning a second one of the plurality of rainscreen panels so that: a bottom edge of the at least two edges of the second one of the plurality of rainscreen panels rests on a top surface of the first short leg of the first rainscreen installation tool; the bottom edge of the at least two edges of the second one of the plurality of rainscreen panels also rests on a top surface of one of the legs of the second rainscreen installation tool; and an adjacent edge of the at least two edges of the second one of the plurality of rainscreen panels is in contact with one of the legs of the second rainscreen installation tool;

attaching the second one of the plurality of rainscreen panels to the supporting structure so that a joint is formed between the first and second ones of the plurality of rainscreen panels.

* * * * *